US006786563B1

(12) United States Patent
Jones

(10) Patent No.: US 6,786,563 B1
(45) Date of Patent: Sep. 7, 2004

(54) INTERLEAVING APPARATUS AND METHODS FOR RADIAL PRINTING

(75) Inventor: Randy Q. Jones, Sunnyvale, CA (US)

(73) Assignee: Elesys, Inc., Sunnyvale, CA (US)

( * ) Notice: Subject to any disclaimer, the term of this patent is extended or adjusted under 35 U.S.C. 154(b) by 0 days.

(21) Appl. No.: 10/125,681

(22) Filed: Apr. 18, 2002

Related U.S. Application Data

(60) Provisional application No. 60/284,847, filed on Apr. 18, 2001.

(51) Int. Cl.[7] ..... B41J 2/01; B41J 3/00

(52) U.S. Cl. ..... 347/2; 347/101; 347/107

(58) Field of Search ..... 347/2, 107

(56) References Cited

U.S. PATENT DOCUMENTS

| | | | | | |
|---|---|---|---|---|---|
| 4,110,594 | A | | 8/1978 | May | 291/121 |
| 4,556,966 | A | | 12/1985 | Bricot et al. | 369/52 |
| 4,721,969 | A | | 1/1988 | Asano | 346/157 |
| 4,739,415 | A | | 4/1988 | Toyono et al. | 358/296 |
| 4,872,026 | A | | 10/1989 | Rasmussen et al. | 346/140 |
| 4,967,286 | A | * | 10/1990 | Nomula et al. | 386/124 |
| 5,019,838 | A | * | 5/1991 | McKinley et al. | 346/121 |
| 5,041,846 | A | | 8/1991 | Vincent et al. | 346/25 |
| 5,115,250 | A | | 5/1992 | Harmon et al. | 346/1.1 |
| 5,154,957 | A | | 10/1992 | Yamada et al. | 428/64 |
| 5,317,337 | A | * | 5/1994 | Ewaldt | 347/2 |
| 5,444,687 | A | | 8/1995 | Okumura | 369/50 |
| 5,468,076 | A | | 11/1995 | Hirano et al. | 400/59 |
| 5,597,590 | A | | 1/1997 | Tanimoto et al. | 425/174.4 |
| 5,634,730 | A | | 6/1997 | Bobry | 400/88 |
| 5,656,229 | A | | 8/1997 | Tanimoto et al. | 264/400 |
| 5,918,540 | A | * | 7/1999 | Fischer | 101/128.4 |
| 5,967,676 | A | | 10/1999 | Cutler et al. | 400/70 |
| 5,978,000 | A | * | 11/1999 | Levine | 346/62 |
| 6,019,151 | A | * | 2/2000 | Wen et al. | 156/387 |
| 6,020,977 | A | * | 2/2000 | Kim | 358/1.7 |
| 6,074,031 | A | * | 6/2000 | Kahle | 347/4 |
| 6,202,550 | B1 | | 3/2001 | Lee et al. | 101/38.1 |
| 6,264,295 | B1 | | 7/2001 | Bradshaw et al. | 347/2 |
| 6,386,667 | B1 | * | 5/2002 | Cariffe | 347/12 |

FOREIGN PATENT DOCUMENTS

| | | | | | |
|---|---|---|---|---|---|
| EP | 140384 | A2 | * | 5/1985 | B41F/27/04 |
| EP | 09265760 | | | 10/1997 | |
| EP | 0952725 | A2 | | 10/1999 | |
| JP | 06031906 | A | * | 2/1994 | B41J/2/01 |
| JP | 09306144 | A | | 11/1997 | G11B/23/40 |
| JP | 2002292939 | A | * | 10/2002 | B41J/3/407 |
| JP | 2002298545 | A | * | 10/2002 | G11B/23/40 |
| JP | 2003019828 | A | * | 1/2003 | B41J/3/407 |
| WO | WO00/32399 | | | 6/2000 | |
| WO | WO 0032399 | | * | 6/2000 | B41J/3/00 |

* cited by examiner

*Primary Examiner*—Lamson Nguyen
*Assistant Examiner*—Leonard Liang
(74) *Attorney, Agent, or Firm*—Beyer, Weaver & Thomas LLP

(57) ABSTRACT

Methods and apparatus for interleaved printing of individual ink objects at target print sectors disbursed around an annular surface on a circular spinning media such as on a CD, dynamically during the radial printing process, are described. Mechanisms for interleaving printing during the radial printing process, enabling the use of commercially available ink jet pens for radial printing directly on CD devices at greater than 2× rotation speeds, and thus reducing pen limitations in firing frequency and recovery time, are disclosed.

22 Claims, 5 Drawing Sheets

INTERLEAVING APPARATUS AND METHODS FOR RADIAL PRINTING

CROSS REFERENCE TO RELATED APPLICATIONS

This application claims priority to U.S. Provisional Patent Application, having application No. 60/284,847 (Attorney Docket No. ELESP005P), filed Apr. 18, 2001, entitled INTERLEAVING METHODS FOR RADIAL PRINTING, by Randy Q. Jones. This application also relates to U.S. Pat. No. 6,264,295, issued Jul. 24, 2001, entitled RADIAL PRINTING SYSTEM AND METHODS by George L. Bradshaw et al. These referenced applications are incorporated herein by reference in their entirety for all purposes.

FIELD OF THE INVENTION

The present invention relates to fluid dispensing devices and methods for printing on spinning circular media. More particularly, it concerns mechanisms for placing ink on spinning circular media discs.

BACKGROUND OF THE INVENTION

In the art of dispensing fluidic ink objects as it applies to radial printing, there is a need to place ink objects efficiently onto the spinning circular media to effectively use the mechanisms of radial printing. Radial printing generally includes dispensing ink onto a media at a particular radius of the media while the media is rotating. Additional challenges exist with physical limitations and interactions of the devices employed, such as with the fluid dispensing device, herein alternately termed "print pen" or "pen," wherein the maximum frequency of the pen's firing cycle, in terms of both the pen's overall fluid firing capacity and recovery time, increase proportionally as spinning rates of CD devices increase.

Commercially available ink jet print pens have inherent limitations as it relates to media spin rates, or in other words, the speed at which the surface to be printed moves past the pen. Two limitations are factors in maximizing print speed of a device using these devices:

(1) The pen recovery latency, after firing, to allow time for the meniscus to recover and the pen ink well to refill, and (2) The maximum pen firing frequency, at which the pen can repetitively fire a burst of nozzles.

For example, a typical ink jet has a pen firing frequency of 12 kHz and a pen recovery time of about 83 $\mu$s, which is adequate to keep pace and print the media consecutively printing 20,480 instantaneous angular counts per rotation for up to about the normal 2× CD media spinning rates of 720 RPM. With even higher rotation speeds, the required pen firing frequencies to print consecutively on the media exceed the capability of the pen.

In other words, the pen's firing frequency and pen recovery latency is currently a limiting factor in the speed that can be achieved in radial printing, wherein CD rotation speeds may substantially exceed the pen's capabilities. In view of the foregoing, there is a need to solve the unique problems associated with printing on a spinning CD. Additionally, printing mechanisms for overcoming a ink pen's firing frequency are needed.

SUMMARY OF THE INVENTION

Accordingly, the present invention provides mechanisms for increased radial printing speeds without a requirement to increase the pen's frequency capability, thus enabling the use of standard commercially available pens in radial printing devices.

The present invention includes several embodiments for placing ink on spinning circular media to solve problems with physical printing limitations, such as pen maximum frequency and pen recovery latency as spinning rates increase. Normal inkjet pen frequency is adequate to keep pace with instantaneous angular velocities for up to twice the spinning media spinning rates. However, with higher rotation speeds, the required pen frequencies can exceed the capability of the pen. Thus, mechanisms are provided in which printing may be accomplished without a requirement to increase the pen frequency capability.

In general terms, this invention uses interleaved radial printing to solve a problem inherent to optimizing the printing time and addresses physical printing limitations, such as pen maximum frequency and pen recovery latency time while printing to spinning circular media. Interleaved radial printing generally includes shifting the firing time to when the print pen is directly over the area to be printed, which herein will be called the "target sector." The print pen is activated at a particular time to produce best results, which herein will be called the "firing zone," which can be visualized as an arch-shaped swath of a limited angular length on the surface of the rotating circular media.

The present invention provides one or more of the following mechanisms to remedy the above and other issues related to radial printing on rotating circular media through the use of interleaved radial printing:

In one general embodiment, the print pen is given shorter band of data to print, interspersed on the same track, which is at the same radial position on the media. In this situation, interleaving operates such that the print pen reprints in more than one rotation: at one and a fraction of a rotation or in two or more rotations. Limitation with pen recovery latency time is addressed through this technique.

In a second general embodiment, the rotation speed of the media may substantially exceed the print pen-firing rate such that the target sector passes several times under the pen-firing zone during any given radial position. In this situation, the print pen may fire at an angular position to optimize the placement of an ink dot onto the media at a rate commensurate with the firing frequency of the print pen. In this way, the print pen can place ink on the surface during any one of subsequent successive rotations, piecing the individual image elements together much like a patchwork quilt. This mechanism may be used to address radial printing limitations such as maximum pen frequency.

In a specific implementation, interlaced timing of all pen firing is directed by the feedback information from a rotary encoder and the pen controller.

In a specific embodiment, a method of printing onto a rotating media is disclosed. The media is rotated at a selected rotation speed. Ink is dispensed onto a first sector of a radial print track of the rotating media during a first rotation of the media. Ink is also dispensed onto a second sector of a radial print track of the rotating media during a second rotation of the media. The radial print track has a larger area than either the first sector or the second sector.

In a specific aspect, ink is dispensed onto a plurality of first sectors of the radial track of the rotating media during the first rotation of the media. In a further aspect, ink is dispensed onto a plurality of second sectors of the radial track of the rotating media during the second rotation of the media. In another specific implementation, the rotation speed is selected so that ink is dispensed onto a first sub-sector and not onto a second sub-sector of the first sector during the first rotation, and ink is dispensed onto the second sub-sector of the first sector during the second rotation. Additionally, the first sub-sector of the first sector is contiguous with the second sub-sector of the first sector. In a related implementation, the rotation speed is selected so that ink is dispensed onto a first sub-sector and not onto a second sub-sector of the second sector during the second rotation, and ink is dispensed onto the second sub-sector of the second sector during the first rotation. The first sub-sector of the second sector is also contiguous with the second sub-sector of the second sector.

In a specific implementation, the second rotation immediately follows the first rotation. In another aspect, a distance between the first and second sectors is equal to a duration of time required by an ink dispensement mechanism to recover after dispensing ink onto the first sector. In a preferred embodiment, the media is an optical recording media disc, such as a CD. In another implementation, the first and second sector are each an arch-shaped swath of a limited angular length on a surface of the rotating media In an alternative embodiment, the invention pertains to a printing system for radially printing onto a rotating media The printing system generally includes a rotation mechanism for rotating the media at a selected rotation speed and a dispensement mechanism for dispensing ink onto a media while the media is rotating under the dispensement mechanism. The printing system further includes a controller for causing the dispensement mechanism to perform one or more of the above described method embodiments.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF SPECIFIC EMBODIMENTS

The present invention will now be described in detail with reference to a few preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

For the scope of this invention, the terms "CD" and "media are intended to mean all varieties of optical recording media discs, such as CD-R, CD-RW, DVD-R, DVD+R, DVD-RAM, DVD-RW, DVD+RW and the like.

The interleaving mechanisms described herein may be integrated within any suitable radial printer. Several embodiments of radial printers are further described in above reference U.S. Pat. No. 6,264,295, by Bradshaw et al, issued Jul. 24, 2001 and U.S. patent application, having application Ser. No. 60/284,847, filed Apr. 18, 2001, entitled INTERLEAVING METHODS FOR RADIAL PRINTING, by Randy Q. Jones, which application is incorporated herein by reference in its entirety for all purposes.

Figure 3:
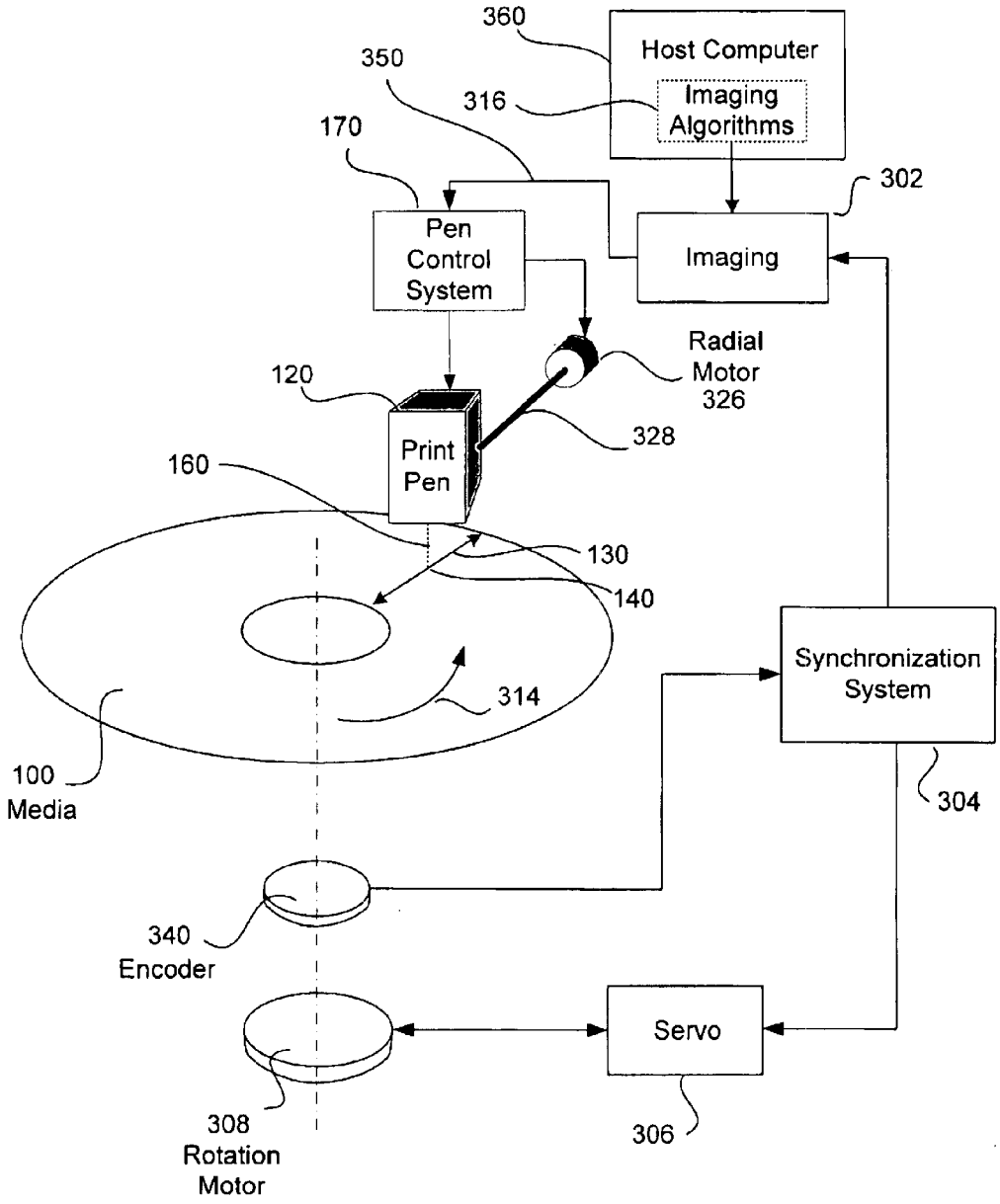
FIG. 3 represents a radial printing system in which the mechanisms of the present invention may be implemented.

FIG. 3 represents a radial printing system in which the mechanisms of the present invention may be implemented. Print pen 120 moves along a radial path 130 by means of a radial motor 326 and actuator 328, while the media 100 spins 314 underneath the pen 120, which fires in along a trajectory 160 to place ink on the disk at a specific target location, also referred to as the print zone 140. The Pen control system 170 controls the positioning and firing of the pen 120. Images from the imaging algorithms 316 are prepared by the imaging system 302 and synchronized with the synchronization system 304 with the rotational information from the encoder 340 and in conjunction with the rotation motor 308 and servo 306. The pen 170 thereby synchronously prints radially to place ink objects at the target print zone 140.

Printing on the rotating media 100 at a given location 140 at a given time often has limitations. In the illustrated embodiment shown in FIG. 1, a typical print pen 120 has two basic speed limitations: the maximum firing frequency and the recovery time. Maximum firing frequency is the fastest rate at which the pen 120 may be fired. "Recovery latency time" is the time that the pen must recover after a burst of firing the pen a plurality of cycles at maximum frequency. To accommodate these kinds of limitations, embodiments of the present invention provide mechanisms for interleaving to minimize print time or, as a corollary, allow printing on rotating media at a higher rotating speed than the print pen would conventionally constrain.

In one embodiment, the interleave mechanisms described herein for radial printing use a technique of delayed radial printing, termed "delayed printing" herein, in which the printing of a particular part of the image is delayed until a subsequent partial or single rotation, or plurality of rotations, of the media makes the "target sector" or "print zone" available to the pen for printing repetitively. Several different embodiments of interleaving could be used in combination or individually to overcome limitations imposed by the print pen.

Figure 1:
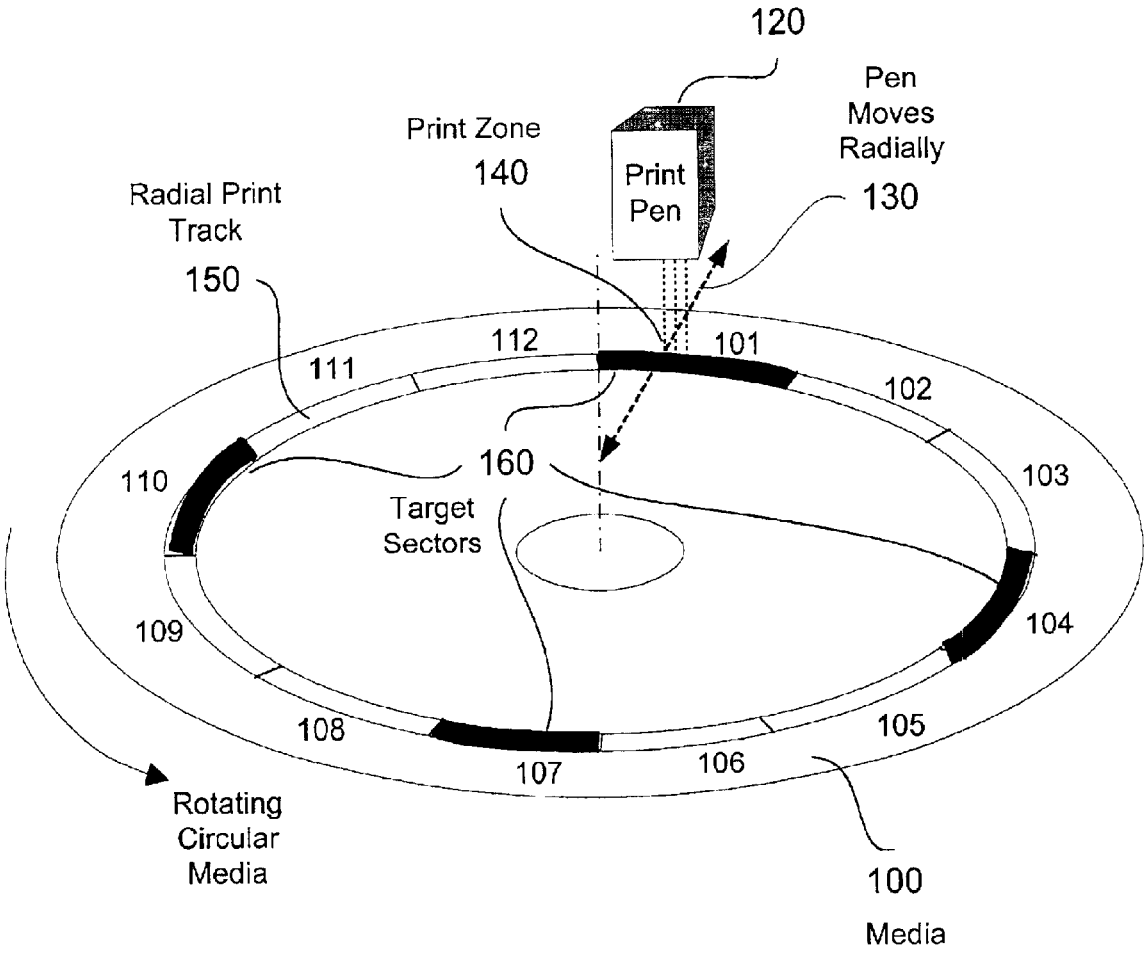
FIG. 1 represents a portion of a radial printing system with media and inkjet pen, depicting the target sectors for interleaved printing in accordance with one embodiment of the present invention.

FIG. 1 illustrates in more detail the principle of the interleaving mechanisms as applied to radial printing in accordance with one embodiment of the present invention. This embodiment uses interleaving to where rotation speed exceeds pen recovery latency time for continuous pen operations, and thus maximizes the pen firing frequency to fire continuously throughout each target sector 160, such that any two consecutive target sectors 101 and 104 may have a plurality of interlude sectors, such as 102 and 103, spaced between each target sector 160. The print pen 120 fires during radial printing. Print pen 120 is mounted over media 100, such that it moves radially along path 130 while the media 100 spins underneath, and prints to a radial print track 150 containing target sectors 160 to print when each respective sector 160 comes under the pen in the print zone 140. Since the same print zone 140 on the rotating media passes under the same print pen 120 repeatedly, these rotational properties can be used to operational advantage, solving the print pen firing cycle limitation problem.

Sectors 160 need not be of equal size or be equally divisible into the circumference of the media to affect delayed radial printing. In such case, the imaging system 302 properly prepares the print instructions 350 for the pen control system 170.

Although delayed printing does not necessarily have to occur on a periodic basis, in some cases periodic delays are useful. Such periodic delays are termed "interleaving" herein. Alternatively, an example of non-periodic delayed printing is a case in which the host computer 360 generating the imaging algorithms 316 is backlogged and cannot deliver data to the imaging system 302 at the necessary time. By delaying the printing one or a plurality of rotations, the host computer 360 generating the imaging algorithms 316 is provided the additional time necessary to perform its computational processing. The delay does not affect output print quality, since the delay is synchronized until the next print sector rotates into the print zone 140. One adverse impact of using too much printing delay is that it may lengthen the overall print duration to print the entire media image.

As shown, in FIG. 1, in one embodiment, for the target sectors 160, one permutation of pen firing fires pen 120 first at sector 101 under print zone 140, then at sector 104, then at sector 107, and finally at sector 110. Alternatively, another permutation of pen firings may be done in the sector order of 101, 107, 104, and 110, respectively. In another permutation of pen firings, the firing order may be done in sector order 101, 110, 107 and 104. In sum, the order of firing, its permutations and combinations in any of a plurality of rotations necessary to cycle through the target sectors 160 for each track 150 is unrestricted. That is, the order of sector firing can assume any permutation or combination of contiguous or noncontiguous target sectors 160 as to affect optimal firing of the print pen 120. Thus, the term "delayed printing" is used herein to describe the target sector printing delay in order to optimized the pen firing, such as the sequence of sectors 101, 104, 107, and 110, respectively.

To complete printing an image on the entire media 100 surface, the host computer 360 in FIG. 3 and pen control system 170 respectively and similarly prepare images and issue the next set of target sectors to be printed, such as sectors 102, 105, 108 and 111, then finally sectors 103, 106, 109 and 112, until all sectors are printed in the band track 150, where upon the print pen 120 is moved by actuator motor 326 and actuator 328 to a new radius and thus start a new radial print track 150; this process repeats for a plurality of radial print tracks 150 on the media 100 surface until the entire surface is printed with an image.

Figure 2:
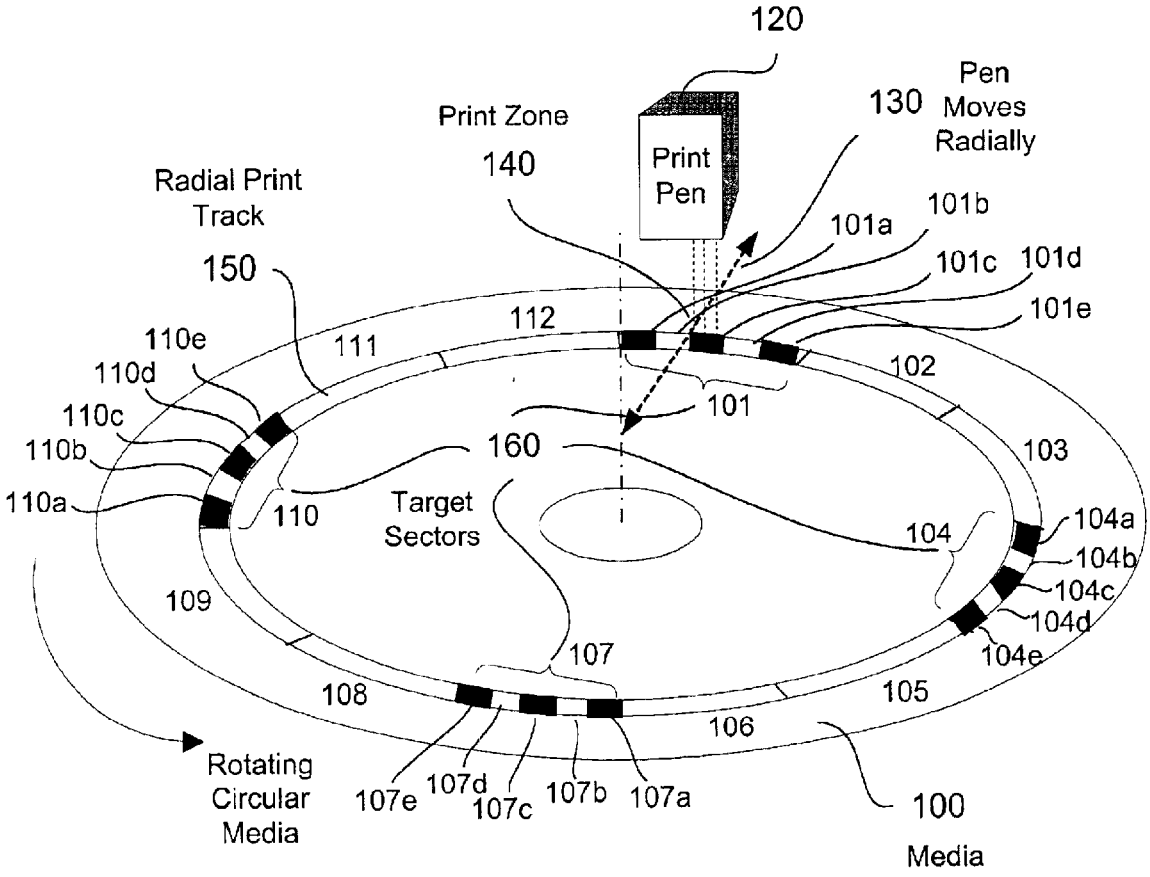
FIG. 2 represents a portion of a radial printing system with media, depicting the sub-sectors for interleaved printing, enabling printing at excessive rotation speeds in accordance with one embodiment of the present invention.

In another embodiment, shown in FIG. 2, a case where the media rotation speed substantially exceeds the print pen-firing rate is depicted. This embodiment uses interleaving to maximize the pen firing frequency with excessive rotational rates, not withstanding the limitations thereof, by using a plurality of sub-sectors, spaced apart with for pen recovery latency time. The target sectors 160 sector pass several times under the pen firing zone during any given radial position and thus are further subdivided into partial or sub-sectors, such as 101*a* or 107*c*, to allow for a pen 120 to fire at an instantaneous angular position to optimize the placement of ink dot onto the media at a rate approaching that of or commensurate with the firing frequency of the print pen 120. In this way, the print pen 120 can place ink on the surface 100 at each sub-sector, such as 101*a* or 107*c*, during any one of subsequent plurality of successive rotations, and thus piece together the plurality of individual image elements into sub-sectors, much like a patchwork quilt. As the pen typically must wait a specific length of time to recover before firing again, interleaving is ideal for solving this recovery time problem.

In a specific implementation, sub-sectors 101*a*, 101*c*, and 101*e* print in succession, followed by sub-sectors 104*a*, 104*c*, and 104*e*, then sub-sectors 107*a*, 107*c*, and 107*e*, and finally sub-sectors 110*a*, 110*c*, and 110*e* print, completing the first pass of burst printing in the first or in a plurality of rotations. Also done in the first succeeding or in a plurality of succeeding rotations and during the next burst printing pass, the gaps left in between the previously printed sub-sectors are printed, such that sub-sectors 101*b* and 101*d* print in succession, followed by sub-sectors 104*b* and 104*d*, then sub-sectors 107*b* and 107*d*, and finally sub-sectors 110*b* and 110*d*, completing the second pass of printing and thus also the first set of target sectors 160 in the track 150 to be printed.

In this second embodiment, to complete printing of an image on the entire media 100 surface, the host computer 360 in FIG. 3 and pen control system 170 respectively and similarly prepare images and issue the next set of target sectors to be printed, such as sectors 102, 105, 108 and 111, then finally sectors 103, 106, 109 and 112, until all sectors are printed in the band track 150. For each group of sectors, interleaving printing is then utilized to print onto interleaved sub-sectors of each sector. After the printing within a particular band of sectors (e.g., 150) is complete, the print pen 120 is moved by actuator motor 326 and actuator 328 to a new radius and thus starts a new radial print track. This process repeats for a plurality of radial print tracks on the media surface 100 until the entire surface is printed with an image. Similar to the first embodiment, a plurality of permutations and combinations of sectors and sub-sectors in any of a plurality of rotations necessary to cycle through a plurality of target sectors 160 without restriction may be used to print the media 100 in this fashion.

In the radial printing environment, the print zone 140 at which a given part of the image may be printed under the pen 120 is available on a periodic basis, the time of which depends on the rotating speed of the media 100. Given print pen frequency limitations, there are physical instances wherein the rotation speed of the media is too fast for the head to print the image contiguously. Thus, interleaving the print positions is a solution to this problem.

In a specific embodiment, interleaving could be used to decrease the head frequency requirements by a factor of two if every other print position, i.e., 101, 103, 105, 107, 109, and 111, respectively, is printed on the first rotation, and the omitted print sectors, 102, 104, 106, 108, 110, and 112, respectively, are printed on the second rotation.

Given the pen recovery latency time limitation, a print pen 120 may not be physically ready to print the next sector after printing a previous sector. In this case, interleaving of the target sectors 160 can address this problem. Matching up the next available sector for print minimizes slack rotating time wherein nothing is printed.

In a specific embodiment, rather than waiting an entire rotation to print the next contiguous print zone, the sectors 160 are printed out of sequence, such as sectors 101, 110, 107 and 104. For example, if the recovery time is the time for one zone to rotate under the print pen, the interleave factor would cause printing of alternate zones on the first rotation, and filling in the zones on the second rotation. Thus, print time is two rotations, rather than when not optimized, many more rotations are needed, up to a plurality of all sectors 101–112 in each track (e.g., 150).

In another specific embodiment, non-periodic delays can be used to address limitations imposed by the performance of the host computer and associated communication links. If the data from the host is not available at the time that the target sector 160 is under the pen 120, the firing will be delayed one or more rotations until the data are ready. Such delays will not affect print quality, but will affect print duration.

The following mechanisms (described in detail above) can be combined together in any suitable combination to provide more complete print coverage at higher rotating speeds in a particular implementation:

1. The host computer limitations may result in delays in image processing and output to the pen, which may be overcome by delayed printing so that sectors are printed in several rotations;
2. Print pen frequency limitations and higher rotating speed rates can be handled using print position interleaving; and
3. The print pen recovery latency time limitations can be overcome by interleaving zones.

Figure 4:
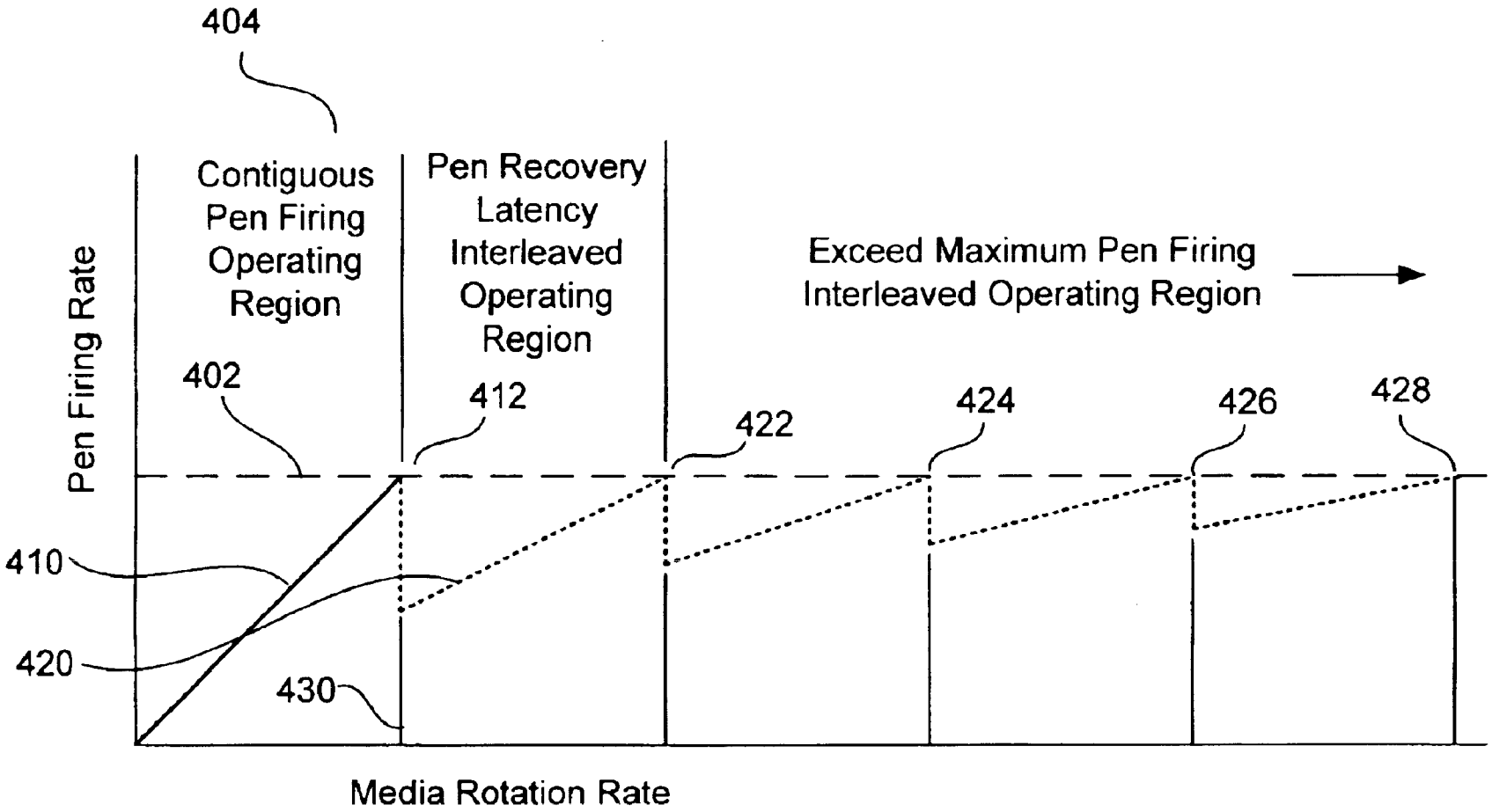
FIG. 4 represents a chart depicting the optimal rotation performance regions for interleaved radial printing.

Actual experimental results with these techniques in prototype of this inventor's design bears out the merits of interleaving for radial printing. For example, FIG. 4 shows a chart depicting the optimal rotation performance regions for interleaved radial printing. Region 404 is the rotation rate at which continuous pen firing 410 occurs, printing all sectors consecutively and contiguously. At point 412, the maximum firing rate 402 of the pen is reached. Without interleaved printing 420, rotation speed 430 would be the final limit for radial printing the media. However, with interleaving, more operating regions are available. For example, if rotation rate 430 was 1× CD spin rate and rotation rate 422 was 2× CD spin rate, then the print speed is substantially identical between contiguous printing 410 versus interleaved printing 420 at points 412 and 422, respectively. At each CD spin rate change, such as 424, 426, 428 and the like, interleave printing 420 is optimal for printing at a substantially similar print speed as the contiguous printing 410, as slow spin rates. This diagram is shown for illustration purposes since the actual optimal rotation speeds may vary due to the selection of the rotation angular count encoder used for interleaved radial printing 420.

Figure 5:
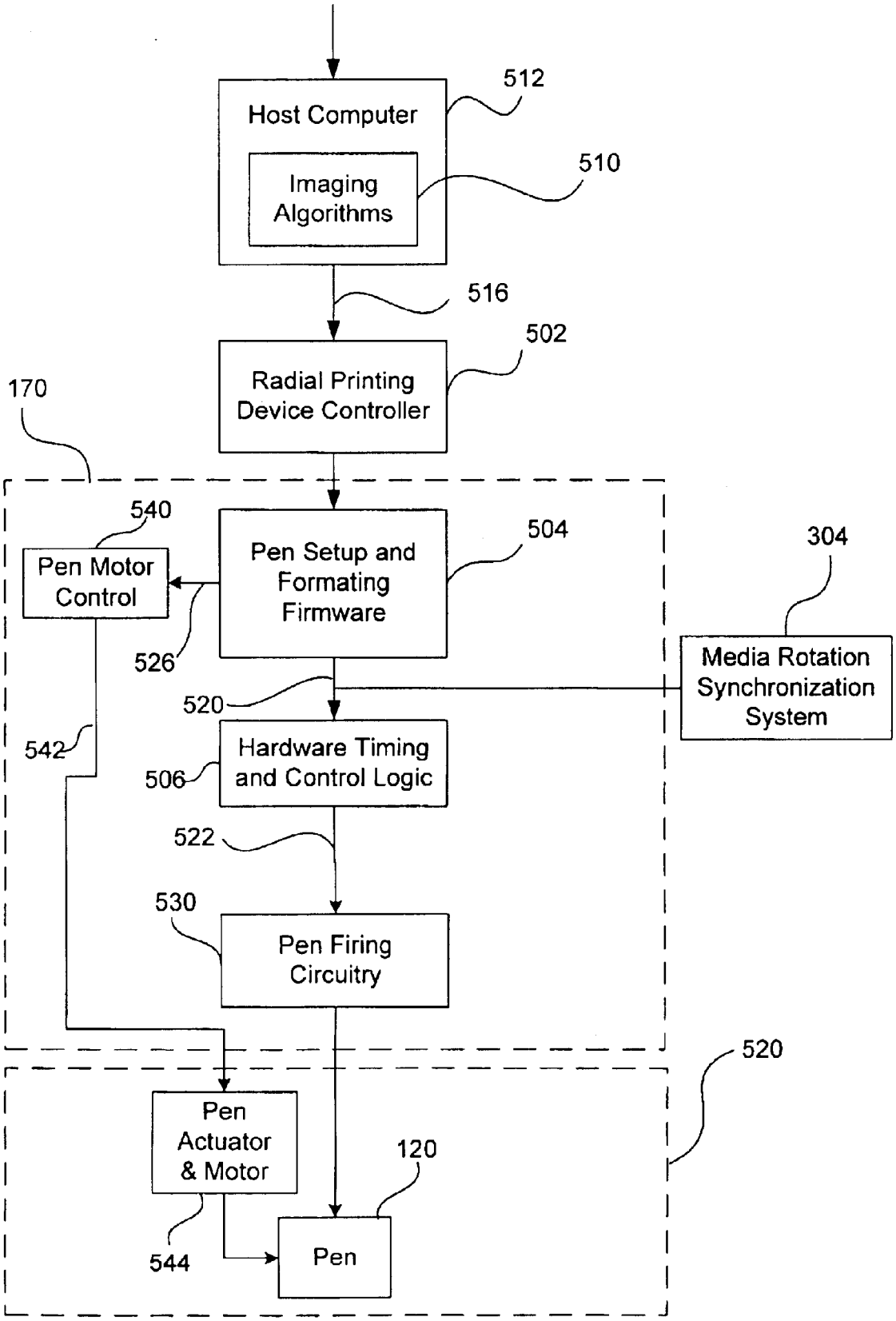
FIG. 5 represents a block diagram of the pen control system in a radial printing system in accordance with one embodiment of the present invention.

FIG. 5 shows a block diagram of a mechanism for precisely controlling pen firing in accordance with one embodiment of the present invention. In the illustrated embodiment, precise control of the pen is obtained though a combination of analog and digital hardware logic circuits, firmware and host-based software, forming a pen control system 170. Of course, any suitable combination of hardware, firmware, and software may be utilized to implement pen firing control. First the firing time is predicted by the host computer 512 image rendering algorithms 510. Next, a command stream 516 is sent to the radial printing device controller 502, which in turn passes the instructions to the pen and formatting firmware 504. This firmware 504 formats a hardware command stream 520 for the hardware timing and control logic 506, commands 526 the pen motor control 540 to in turn command 542 the pen actuator and motor 544 to move the head assembly 420 to the target print track 150 (e.g., FIG. 1 or 2). Thereafter, the firmware 504 sets up the hardware timing and control logic 506 registers and commands 522 the pen 120 to fire in concert with the media rotation synchronization system 304 inputs, to assure the correct instantaneous angular position for the print zone 140 (e.g., FIG. 1 or 2). These control signal commands 522 are issued to the pen firing circuitry 530, whereupon the pen 130 then fires the ink droplets in the correct trajectory 160 (e.g., FIG. 3) to impinge at the print zone 140.

To date, interleaving has effectively allowed optimizing the printing a onto a CD type media from 100 RPM to over the 2× maximum rate of 720 RPM using a pen with a 12 kHz maximum firing frequency. The above described embodiments of the present invention address one or more of these areas:

(1) Provides a mechanism for radially printing CD discs, or other media type, faster than the physical firing cycle-time limitations of the print pen.

(2) Minimizes the limitations on radial printing when increasing CD recording device speeds (or other device type speeds) for radial printing devices that incorporate a CD device to affect spinning of the media (3) Enables integration of radial printing on CD recording devices that spin faster than the print pen physical cycle time, and thus enables use of ordinary ink jet pens in said radial printing.

One advantage of the printing system disclosed herein is that in as much as printing radially allows for multiple passes over the same point on the spinning media, a plurality of opportunities exists to print onto the media surface as it spins underneath the print pen. By employing the mechanisms of interleaving for radial printing, the media can be printed independently of the spinning rate, notwithstanding the physical print pen firing limitations. Thus, a device can be fashioned that merges a radial printer, which would more optimally print to a more slowly rotating speed CD, with an CD recording device, which record and spins substantially faster.

Other embodiments, using similar methods for interleaving for radial printing are similarly contemplated. While this invention has been described in terms of several preferred embodiments, there are alterations, permutations, and equivalents, which fall within the scope of this invention. It is therefore intended that the following appended claims be interpreted as including all such alterations, permutations, and equivalents as fall within the true spirit and scope of the present invention.

What is claimed is:

1. A method of printing onto a rotating media, comprising:

rotating the media at a selected rotation speed, the media having a radial print track that is subdivided into a plurality of sectors such that the plurality of sectors have a same radius, each sector comprising an annular portion of the radial print track;

dispensing ink onto a first sector of the plurality of sectors during a first rotation of the media; and dispensing ink onto a second sector of the plurality of sectors during a second rotation of the media, wherein the radial print track has a larger area than either the first sector or the second sector and wherein the second rotation of the media occurs within any one of subsequent successive rotations after the first rotation of the media.

2. A method as recited in claim 1, wherein ink is dispensed onto a plurality of said first sectors during the first rotation of the media.

3. A method as recited in claim 2, wherein ink is dispensed onto a plurality of said second sectors during the second rotation of the media.

4. A method as recited in claim 1, wherein the second rotation immediately follows the first rotation.

5. A method as recited in claim 1, wherein a time for an ink dispensement mechanism to traverse a distance between the first and second sectors is greater or equal to a duration of time required by the ink dispensement mechanism to recover after dispensing ink onto the first sector.

6. A method as recited in claim 1, wherein the media is an optical recording media disc.

7. A method as recited in claim 1, wherein the first and second sector are each an arch-shaped swath of a limited angular length on a surface of the rotating media.

8. A method as recited in claim 1, wherein the selected rotation speed is greater than 2× media spinning rates.

9. A method of printing onto a rotating media, comprising:

rotating the media at a selected rotation speed;

dispensing ink onto a first sector of a radial print track of the rotating media during a first rotation of the media, the radial print track having a corresponding radius; and dispensing ink onto a second sector of the radial print track of the rotating media during a second rotation of the media, wherein the radial print track has a larger area than either the first sector or the second sector and wherein the second rotation of the media occurs within any one of subsequent successive rotations after the first rotation of the media, wherein the rotation speed is selected so that ink is dispensed onto a first sub-sector and not onto a second sub-sector of the first sector during the first rotation, the method further comprising dispensing ink onto the second sub-sector of the first sector during the second rotation, the first sub-sector of the first sector being contiguous with the second sub-sector of the first sector.

10. A method as recited in claim 9, wherein the rotation speed is selected so that ink is dispensed onto a first sub-sector and not onto a second sub-sector of the second sector during the second rotation, the method further comprising dispensing ink onto the second sub-sector of the second sector during the first rotation, the first sub-sector of the second sector being contiguous with the second sub-sector of the second sector.

11. A printing system for radially printing onto a rotating media, comprising:

a rotation mechanism for rotating the media at a selected rotation speed, the media having a radial print track that is subdivided into a plurality of sectors such that the plurality of sectors have a same radius, each sector comprising an annular portion of the radial print track;

a dispensement mechanism for dispensing ink onto the media while the media is rotating under the dispensement mechanism; and a controller for causing the dispensement mechanism to:

dispense ink onto a first sector of the plurality of sectors during a first rotation of the media; and dispense ink onto a second sector of the plurality of sectors during a second rotation of the media, wherein the radial print track has a larger area than either the first sector or the second sector and wherein the second rotation of the media occurs within any one of subsequent successive rotations after the first rotation of the media.

12. A printing system as recited in claim 11, wherein ink is dispensed onto a plurality of said first sectors during the first rotation of the media.

13. A printing system as recited in claim 12, wherein ink is dispensed onto a plurality of said second sectors during the second rotation of the media.

14. A printing system as recited in claim 11, wherein the second rotation immediately follows the first rotation.

15. A printing system as recited in claim 11, wherein a time for an ink dispensement mechanism to traverse a distance between the first and second sectors is greater or equal to a duration of time required by the ink dispensement mechanism to recover after dispensing ink onto the first sector.

16. A printing system as recited in claim 11, wherein the media is an optical recording media disc.

17. A printing system as recited in claim 11, wherein the first and second sector are each an arch-shaped swath of a limited angular length on a surface of the rotating media.

18. A printing system as recited in claim 11, wherein the selected rotation speed is greater than 2× media spinning rates.

19. A printing system for radially printing onto a rotating media, comprising:

a rotation mechanism for rotating the media at a selected rotation speed;

a dispensement mechanism for dispensing ink onto the media while the media is rotating under the dispensement mechanism; and a controller for causing the dispensement mechanism to:

dispense ink onto a first sector of a radial print track of the rotating media during a first rotation of the media, the radial print track having a corresponding radius; and dispense ink onto a second sector of the radial print track of the rotating media during a second rotation of the media, wherein the radial print track has a larger area than either the first sector or the second sector and wherein the second rotation of the media occurs within any one of subsequent successive rotations after the first rotation of the media, wherein the rotation speed is selected so that ink is dispensed onto a first sub-sector and not onto a second sub-sector of the first sector during the first rotation, the controller being further arranged to cause the dispensement mechanism to dispense ink onto the second sub-sector of the first sector during the second rotation, the first sub-sector of the first sector being contiguous with the second sub-sector of the first sector.

20. A printing system as recited in claim 19, wherein the rotation speed is selected so that ink is dispensed onto a first sub-sector and not onto a second sub-sector of the second sector during the second rotation, the controller being further arranged to cause the dispensement mechanism to dispense ink onto the second sub-sector of the second sector during the first rotation, the first sub-sector of the second sector being contiguous with the second sub-sector of the second sector.

21. A method of printing onto a rotating media, comprising:

rotating the media at a selected rotation speed;

dispensing ink onto a first sector of a radial print track of the rotating media during a first rotation of the media, the radial print track having a corresponding radius; and dispensing ink onto a second sector of the radial print track of the rotating media during a second rotation of the media, wherein the radial print track has a larger area than either the first sector or the second sector and wherein the second rotation of the media occurs within any one of subsequent successive rotations after the first rotation of the media, wherein the radial print track includes a plurality of contiguous sectors such that ink is dispensed onto a plurality of first sectors of the radial track of the rotating media during the first rotation of the media, each first sector being spaced apart from each other by an interlude sector.

22. A printing system for radially printing onto a rotating media, comprising:

a rotation mechanism for rotating the media at a selected rotation speed;

a dispensement mechanism for dispensing ink onto the media while the media is rotating under the dispensement mechanism; and a controller for causing the dispensement mechanism to:

dispense ink onto a first sector of a radial print track of the rotating media during a first rotation of the media, the radial print track having a corresponding radius; and dispense ink onto a second sector of the radial print track of the rotating media during a second rotation of the media, wherein the radial print track has a larger area than either the first sector or the second sector and wherein the second rotation of the media occurs within any one of subsequent successive rotations after the first rotation of the media, wherein the radial print track includes a plurality of contiguous sectors such that ink is dispensed onto a plurality of first sectors of the radial track of the rotating media during the first rotation of the media, each first sector being spaced apart from each other by an interlude sector.

* * * * *